US011044970B1

(12) United States Patent
Chan et al.

(10) Patent No.: US 11,044,970 B1
(45) Date of Patent: Jun. 29, 2021

(54) ATTACHMENT SYSTEM WITH QUICK RELEASE

(71) Applicant: Duraflex Hong Kong Limited, Hong Kong (CN)

(72) Inventors: Yick Fai Chan, Hong Kong (CN); Po Chu Lin, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 16/833,974

(22) Filed: Mar. 30, 2020

(51) Int. Cl.
*A44B 11/28* (2006.01)
*A44B 11/00* (2006.01)

(52) U.S. Cl.
CPC ..... *A44B 11/28* (2013.01); *A44B 11/006* (2013.01)

(58) Field of Classification Search
CPC ..... A44B 11/266; A44B 11/2519; A44B 11/2515; A44B 11/28; A44B 11/006
See application file for complete search history.

(56) References Cited

U.S. PATENT DOCUMENTS 4,688,337 A * 8/1987 Dillner ..... A44B 11/266 24/615
5,465,472 A * 11/1995 Matoba ..... A44B 11/266 24/625
5,706,560 A 1/1998 Anscher et al.
6,421,889 B1 * 7/2002 Chien ..... A44B 11/266 24/614
6,571,433 B2 * 6/2003 Uehara ..... A44B 11/266 24/614
7,055,226 B2 * 6/2006 Uehara ..... A44B 11/266 24/625
7,174,609 B2 * 2/2007 Park ..... A44B 11/266 24/614
8,365,368 B2 * 2/2013 Kaneko ..... A44B 11/266 24/625
9,113,680 B2 * 8/2015 Takazakura ..... A44B 11/266
9,930,937 B2 * 4/2018 Nanbu ..... A44B 11/266
2008/0178438 A1 * 7/2008 Yoshie ..... A44B 11/266 24/616
2011/0061211 A1 * 3/2011 Anscher ..... A44B 11/266 24/190
2012/0017347 A1 * 1/2012 Strum ..... A45F 5/02 2/69

* cited by examiner

*Primary Examiner* — Robert Sandy
(74) *Attorney, Agent, or Firm* — Collard & Roe, P.C.

(57) ABSTRACT

A system for attachment to webbing has an attachment portion and an operating portion that can be attached to and detached from each other. The attachment portion has a base body with a cavity, a transverse bar, and two locking hooks. The operating portion has two side legs, top sections connected to the side legs, a gap between the top sections and a locking hook on each of the top sections. The operating portion is connectable to the attachment portion by pressing the legs together and inserting the locking hooks of the operating portion into the base body, and then releasing the legs so that the locking hooks of the attachment portion and operating portion engage each other. The operating portion is detachable from the attachment portion by squeezing the legs together until the locking hooks on the operating portion clear the locking hooks on the attachment portion.

10 Claims, 8 Drawing Sheets

ATTACHMENT SYSTEM WITH QUICK RELEASE

BACKGROUND OF THE INVENTION

1. Field of the Invention

This invention relates to an attachment system for attaching a buckle, D-ring or other structure to a length of webbing or a strap. In particular, the invention relates to an attachment system that can be quickly and easily attached or detached from the structure, so that the structure can be removed from the webbing without adjusting the webbing.

2. The Prior Art

A plastic fastener is often used to connect two sections of a webbing that bear tension, has the purposes such as lacing and adjustment, and is widely used in bags and suitcases. Common fasteners can often take the form of a two-piece side release buckle having a male portion and a female portion. As for the connection between the male and female portions and the webbing, the webbing is usually sewn around a closed cross bar, and the closed cross bar is integrally formed with the fastener, thus achieving the advantages of a low cost and high durability. However, this kind of closed cross bar cannot be replaced, which results in the lack of rework elasticity in production and also blocks the development of a repairing market at the consumer end. Therefore, fasteners with a quick release function were designed, which allow the removal of the fastener without affecting the structure of the fastener or of the webbing. For example, some buckles are equipped with a slot in the cross bar, so that the buckle can be removed by sliding the webbing through the slot until it clears the bar. However, due to the slot, the strength of the cross-bar in this situation is significantly reduced, so that the device is prone to breakage under large degrees of tension. In another solution such as disclosed in U.S. Pat. No. 5,706,560 to Anscher, the webbing attachment bar can be unclipped from the buckle at one end to release the webbing. This too has reduced strength as compared to a single piece closed cross-bar, due to the unbalanced stress on the two ends, causing the weaker edge to break first. While these devices can be useful, it would be desirable to have a quick-attach system that is completely independent of the webbing.

SUMMARY OF THE INVENTION

It is therefore an object of the invention to provide an attachment system that can be quickly and easily detached from the strap or webbing, yet does not compromise the strength or integrity of the device. This object is accomplished according to the invention by a device for attachment to webbing or a strap, comprising an attachment portion and an operating portion that can be easily attached to and detached from each other. The attachment portion comprises a base body having front and back walls with a cavity between the front and back walls, at least one transverse bar connected to the base body and separated from the base body by a gap, and two locking hooks extending into the cavity in a direction opposite the at least one transverse bar.

The operating portion has two side legs, top sections connected to the side legs and a gap between the top sections. The operating portion is pliable so that squeezing the side legs together narrows the gap. Each of the top sections of the operating portion has a locking hook extending therefrom. The operating portion is connectable to the attachment portion by pressing the side legs together and inserting the locking hooks of the operating portion into the cavity of the attachment portion, and then releasing the side legs so that the locking hooks of the attachment portion engage the locking hooks of the operating portion. The operating portion is detachable from the attachment portion by squeezing the side legs together until the locking hooks on the operating portion clear the locking hooks on the attachment portion, and moving the operating portion away from the attachment portion.

In one embodiment, there can be at least one, and preferably two prongs extending from the attachment portion opposite the at least one transverse bar. The prongs are disposed in the gap between the top sections of the operating portion when the operating portion is attached to the attachment portion and help to guide the operating portion into alignment with the attachment portion while connecting the two portions together. In another embodiment, the device does not have any prongs.

In use, a strap is connected to the attachment portion and extends through a space between the transverse bar and the base body, and around a bottom of the attachment portion, and is then closed in a loop, so that the base body is contained within the loop. When the attachment portion is connected to the operating portion the strap extends around a bottom of the top sections of the operating portion as well. In practical use, the attachment portion is first placed in the webbing loop, and the legs of the operating portion span left and right sides of the webbing loop. The operating portion is fastened to the attachment portion as described above, so that the corresponding locking hooks of each of the portions engage each other. The other end of the operating portion can be attached to a second strap or loop of webbing as well.

Once connected, the assembly of the attachment portion and operating portion is therefore firmly fastened into the webbing loop. When external tension is applied on the operating portion, and it is attempted to pull the assembly of the attachment portion and operating portions away from the webbing loop, the underside of the top sections of the operating portion are continuously pressed against an inner side of the webbing loop. When the tension continues to increase beyond the form that the material of the attachment portion can maintain, the legs will gradually deform in an attempt to escape toward the gap. However, this just presses the locking hooks of the operating portion more deeply into the attachment portion, thus strengthening the connection. The possibility of the legs escaping from the webbing is thus counteracted and prevented. The higher the tension is, the stronger the counter-acting force provided by the webbing. The structure of the present invention is easy to assemble and allows for arbitrary assembly and disassembly without affecting the sewn webbing loop. In an assembled state, the tension and the general fastener are just as strong as a conventional system without the quick release function.

The webbing can be formed from any suitable material, such as polypropylene, polyethylene, nylon, cloth or any suitable material in the form of a belt, strap, tape, etc.

In one embodiment, rear wall of the attachment portion has apertures therein so that the locking hooks of the operating portion are visible through the apertures when the operating portion is connected to the attachment portion.

The operating portion can be any suitable functional object. In one embodiment, the operating portion is a D-ring. In another embodiment, the operating portion is a female portion of a two-piece side-release buckle, wherein the operating portion has a main body connected to the side legs, with a cavity within the main body for receiving a male portion of the side-release buckle. The operating portion could also form the male portion of a side-release buckle. Other suitable objects are a male buckle or female buckle of a sliding buckle, a swivel hook buckle, a swivel square ring, a press release buckle, a ladder buckle, a tri-glide buckle, an O-ring, a square ring, a triangular ring, a snap hook, or a rope-adjusting buckle. It can also be any electronic device: a light-emitting device, a video screen, a telephone, a remote contact tool, a video camera, a video recorder, a microphone, an amplifier, a fan cooler, a fan heater, an insulation device, a portable power source, an electronic protective case, a tension meter, etc.

In a preferred embodiment, the side legs are disposed entirely outside of the base body when the operating portion is connected to the attachment portion. This makes it easier to attach the operating portion to the attachment portion, as only the ends of the top sections having the locking hooks enter the cavity of the base body, leaving the side legs outside of any interference with the webbing loop. The side legs can be equipped with ridges to increase a user's grip. Other gripping structures could also be used.

In another embodiment, the device can be used on a Molle (Modular Lightweight Load-carrying Equipment) system, where the device is sewn in place on a tactical vest by sewing two ends of the strap that extends around the attachment portion. The operating portion can then be switched out as needed, keeping the attachment portion in place.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 2:
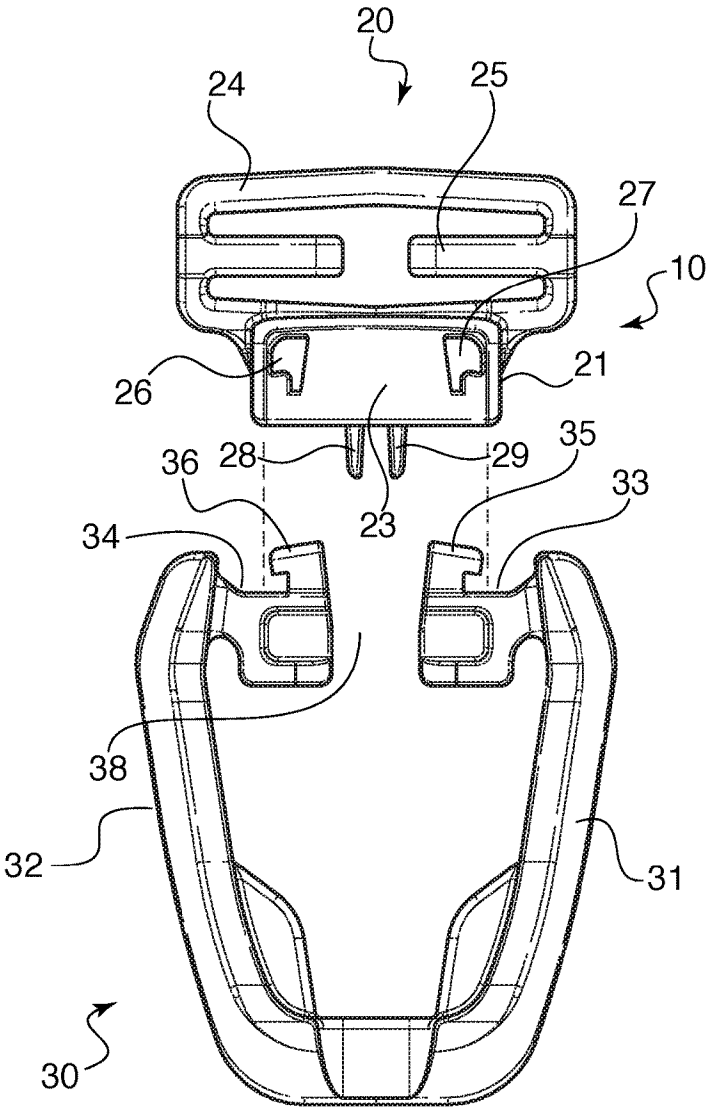
FIG. 2 is a rear view of the attachment system in a disassembled state.
Figure 1:
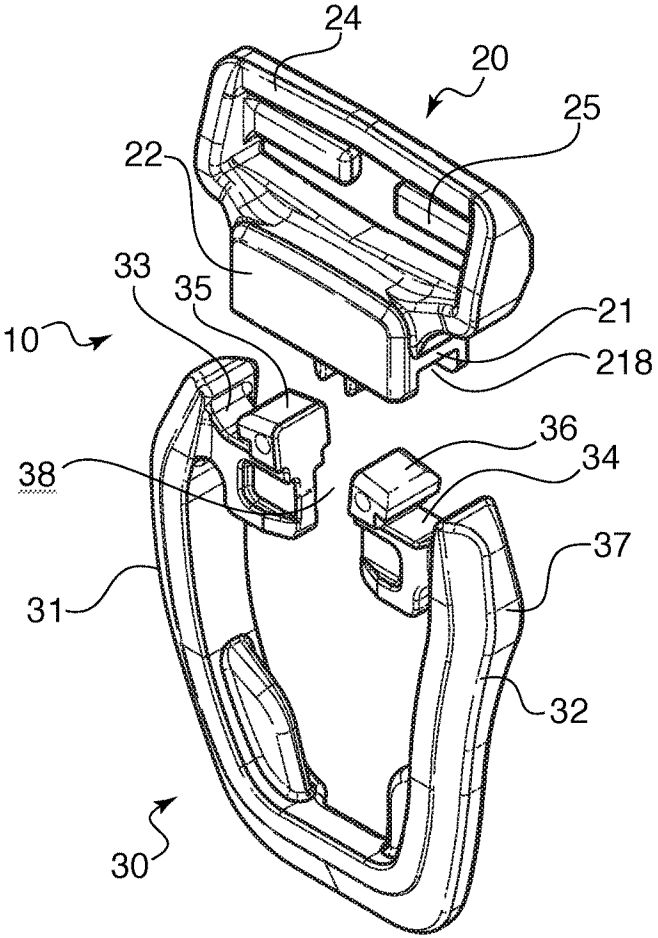
FIG. 1 is a perspective view of the attachment system according to the invention.
Figure 3:
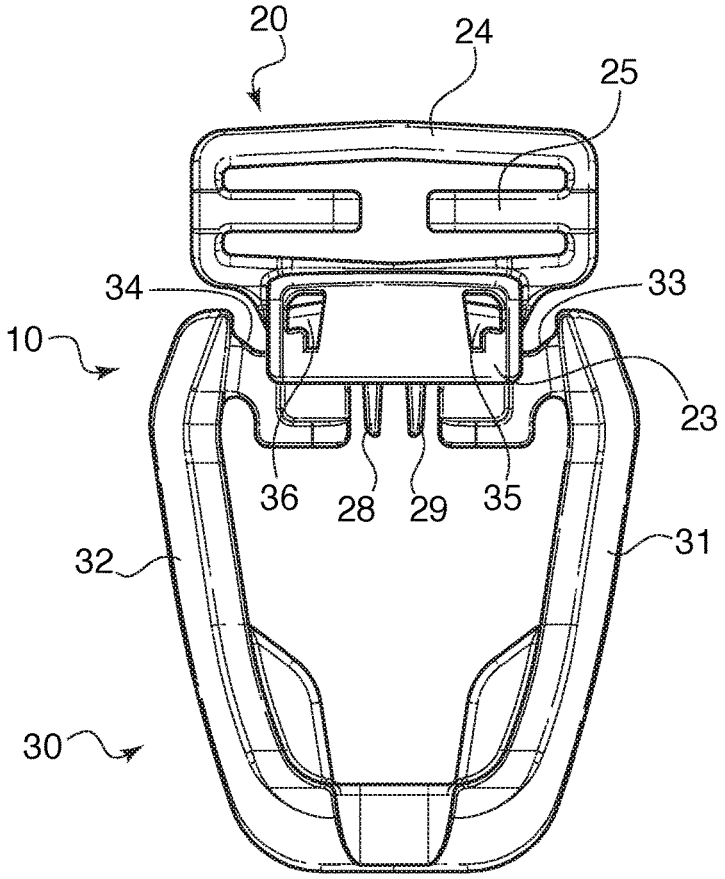
FIG. 3 is a front view of the attachment system as assembled.

Referring now in detail to the drawings, FIGS. 1-3 show a first embodiment of the system 10 according to the invention. System 10 consists of an attachment portion 20 and an operating portion 30, which are configured to be attached and detached from each other with a simple action. Attachment portion 20 has a base body 21 formed from a front wall 22 and a rear wall 23, with a cavity 218 between the front wall 22 and rear wall 23. A transverse bar 24 is connected to base body 21 and separated by a gap in which a second transverse bar 25 is located. Transverse bar 25 is separated by a slot to allow for webbing attachment during use. Two prongs 28, 29 extend down from base body within cavity 218. As shown in the cross-section in FIG. 8, locking hooks 201, 202 extend from base body 21 within cavity 218, on either side of prongs 28, 29. In an alternative embodiment, these prongs can be eliminated. Locking hooks 201, 202 face each other.

Operating portion 30 is in the form of a D-ring and is formed from two side legs 31, 32, which are each connected to an inwardly extending top section 33, 34, respectively. Top sections 33, 34, are separated by a gap 38. Top section 33 has a locking hook 35 extending upward therefrom, and top section 34 has another locking hook 36 extending therefrom. The locking hooks 35, 36 each face outward, away from the gap. The operating portion 30 is constructed of a pliable material, so that pressing legs 31, 32, together causes the gap to narrow and the locking hooks 35, 36, to move toward each other. The rear wall of the attachment portion 20 has apertures 26, 27 therein so that the locking hooks 35, 36 of the operating portion 30 are visible through the apertures 26, 27 when the operating portion 30 is connected to the attachment portion 20.

Figure 5:
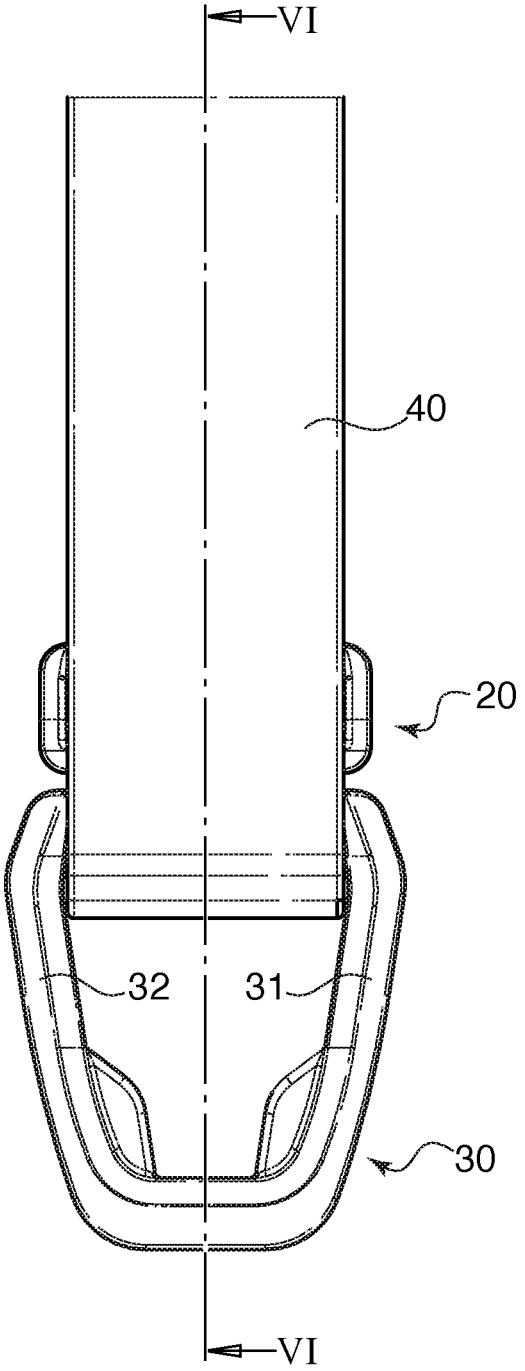
FIG. 5 is a front view of the entire attachment system connected with the webbing loop.
Figure 6:
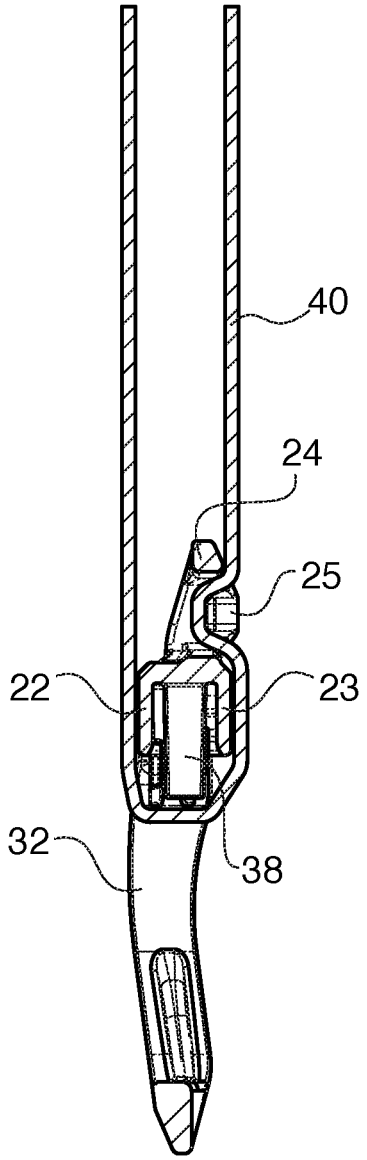
FIG. 6 is a cross-sectional view along lines VI-VI of FIG. 5.

FIG. 3 shows attachment portion 20 and operating portion 30 connected to each other, the details of which will be explained below with reference to FIG. 8. The system 10 according to the invention is configured so that the operating portion 30 can be connected to a strap 40, as shown in FIGS. 4-7, in a secure and reliable manner, yet be easily detachable from attachment portion 20. To assemble the system, strap 40 is first sewn in a loop that serves as a rigid point for attachment bar 25 to attach attachment portion 20 within the loop, as shown in FIG. 6. The closed end of the loop is not shown, as it can be located at any distance from attachment portion 20. As the attachment bar 25 is a transverse bar separated by a gap, the two ends of the loop of strap 40 can enter the attachment bar 25 through the gap. When attached, attachment portion 20 is securely held in place inside the loop of strap 40. It can be undone and reused within the other loops of strap 40 or any other strap.

Figure 7:
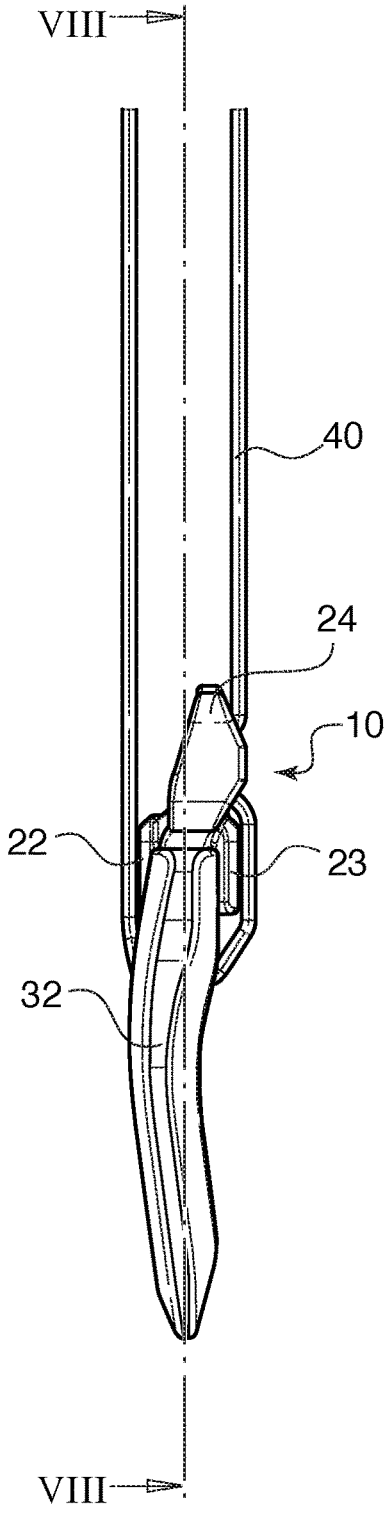
FIG. 7 is a side view of the attachment system with a webbing loop attached.
Figure 8:
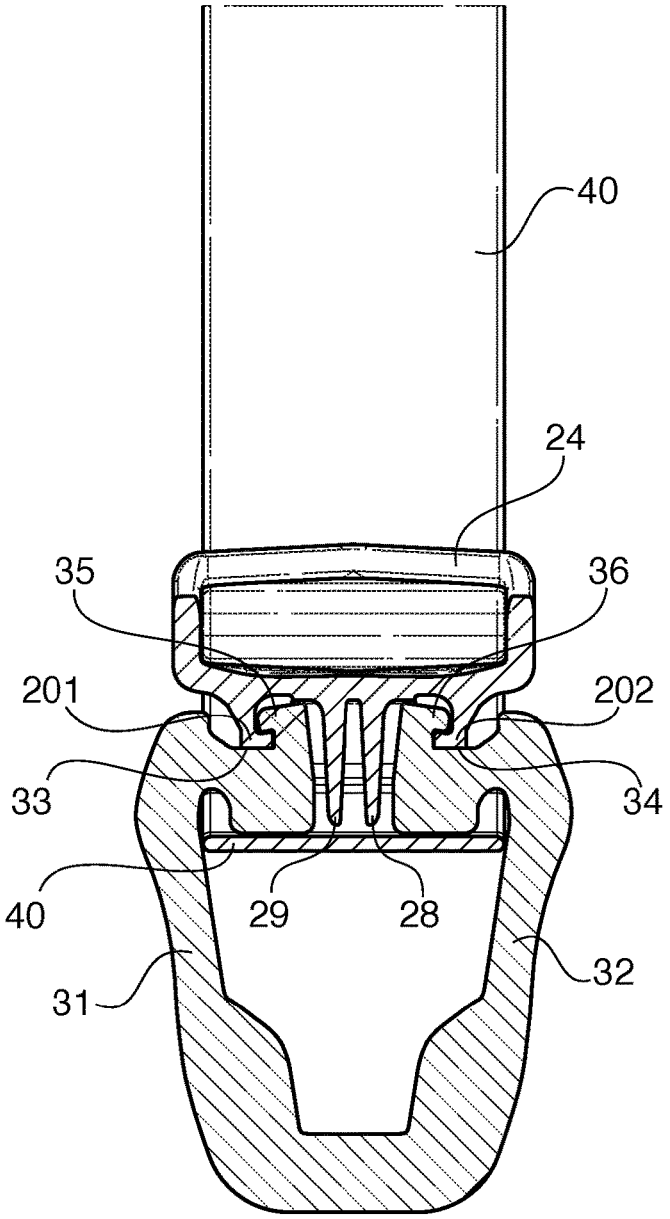
FIG. 8 is a cross-sectional view along lines VIII-VIII of FIG. 7.

Then, operating portion 30 is connected to attachment portion 20 with strap 40 already attached, by inserting locking hooks 35, 36 into cavity 218 until locking hooks 35, 36 engage locking hooks 201, 202 on attachment portion 20, as shown in the cross-section in FIG. 8. During assembly, strap 40 is placed between top sections 33, 34, which then extend into the loop on either side of strap 40, and hooks 35, 36 are then attached to attachment portion 20 within the loop of strap 40, so that strap 40 now wraps around the underside of top sections 33, 34 of operating portion 30, such as shown in FIGS. 5-7.

Upward tension on strap 40 away from operating portion 30 presses operating portion 30 toward attachment portion 20, preventing any chance of separation. As the tension increases, either by increased tension on strap 40, or by tension from a strap attached to the bottom of operating portion 30, legs 31, 32 and top sections 33, 34 are deformed, which presses hooks 35, 36 even more tightly into engagement with hooks 201,202 within attachment portion 20, by the pressure of strap 40. Thus, the tighter the tension on strap 40, the more secure the connection between operating portion 30 and attachment portion 20. To detach operating portion 30 from attachment portion 20, the tension on strap 40 is slackened to create room for movement, and the user presses legs 31, 32 toward each other until locking hooks 35, 36 clear locking hooks 201, 202, at which point operating portion 30 can be disengaged from strap 40 through gap 38.

Figure 9:
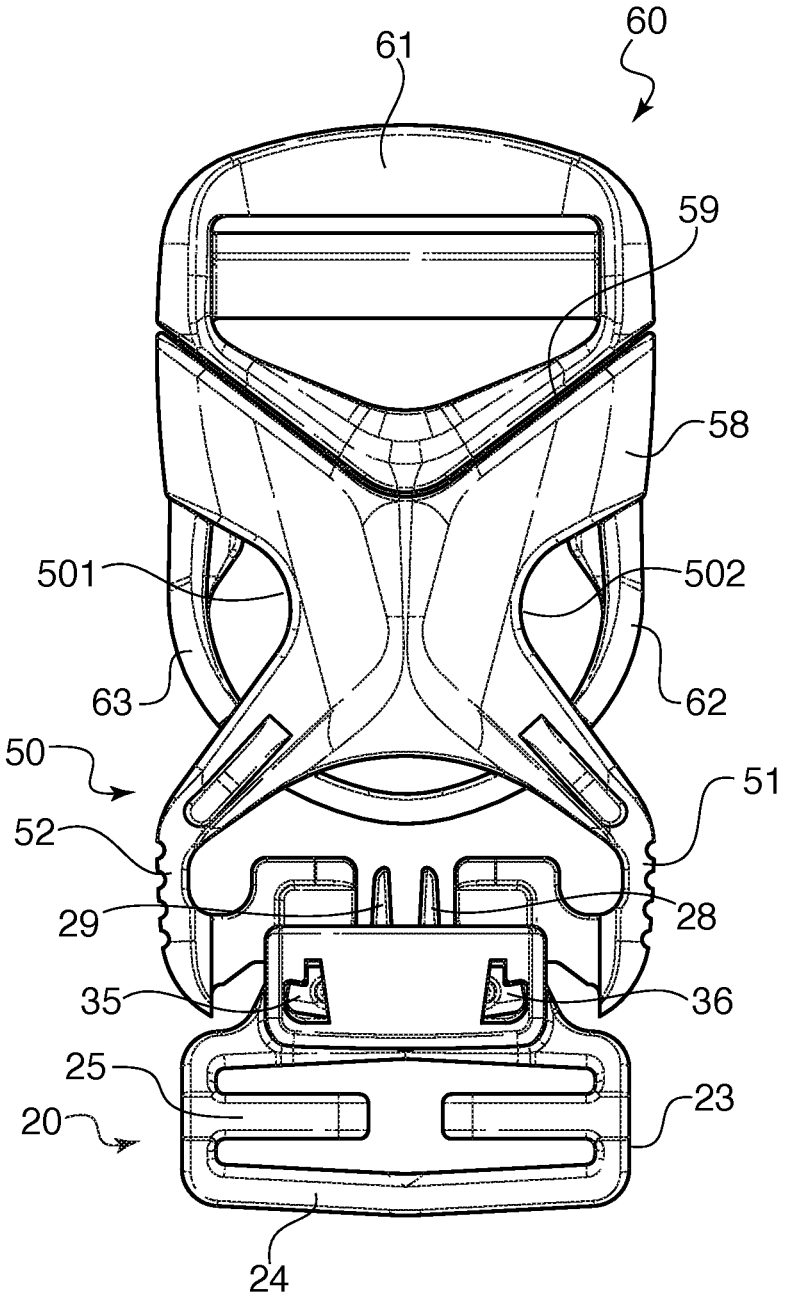
FIG. 9 is a front view of an alternative embodiment of the attachment system.
Figure 10:
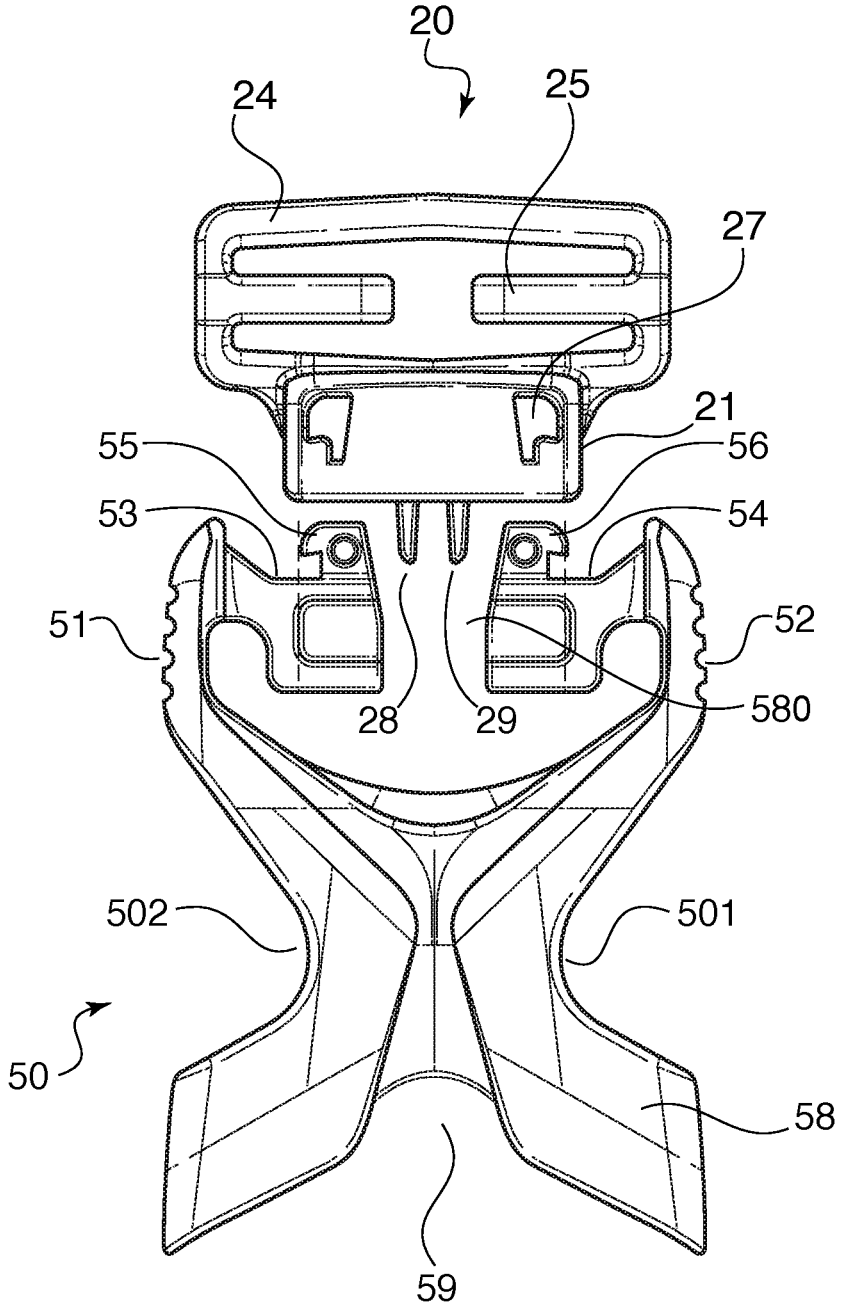
FIG. 10 is a front view of a portion of the attachment system of FIG. 9 in a disassembled state.
Figure 11:
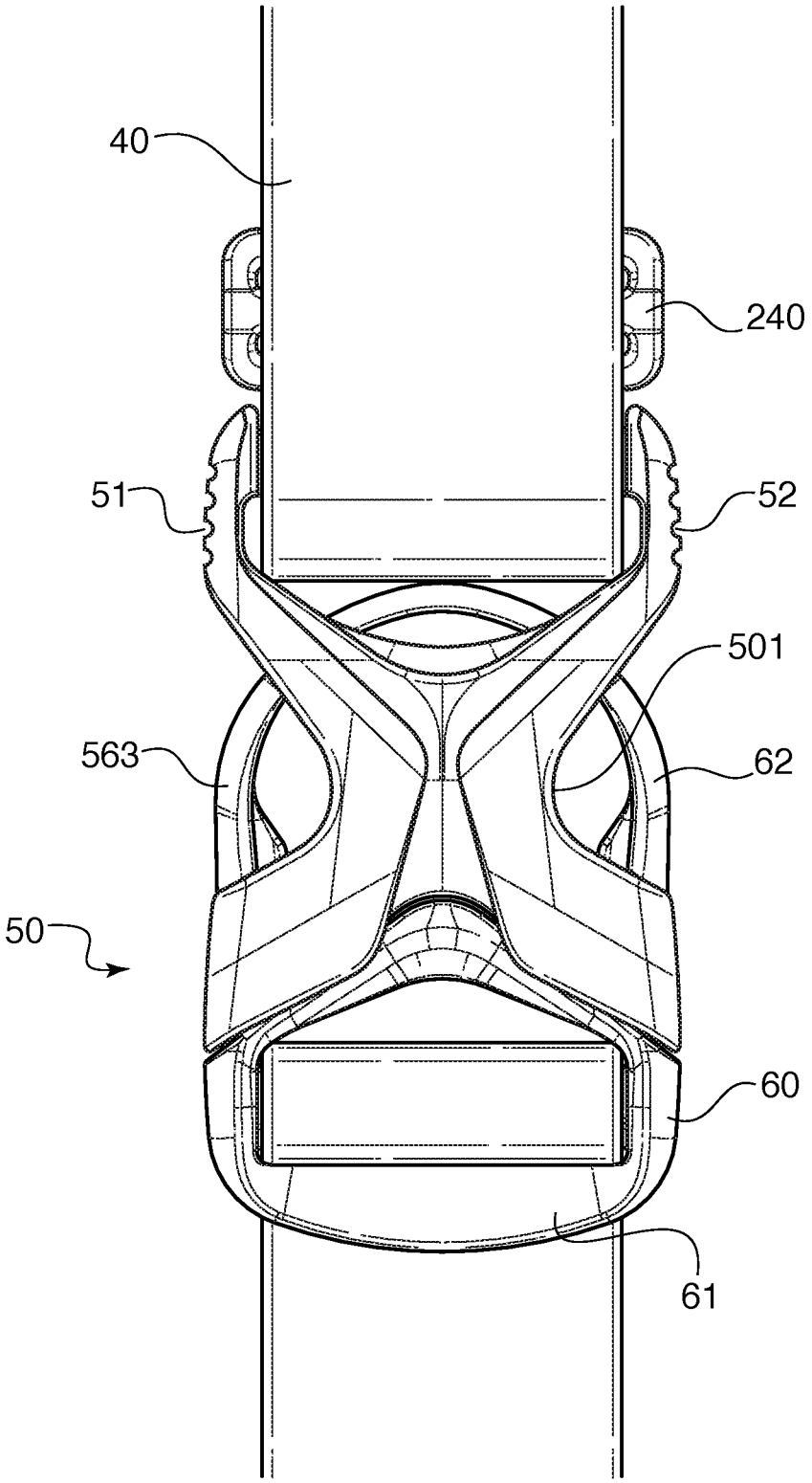
FIG. 11 is a front view of the attachment system of FIG. 9 with a webbing loop attached.

Another embodiment of the attachment system is shown in FIGS. 9-11. Here, instead of a D-ring, operating portion 50 is a female part of a two-piece side-release buckle. Operating portion 50 comprises a female buckle body 58 having two side openings 501, 502 for receiving side legs 62, 63 of a corresponding male buckle body 60. Female buckle body 58 has two side legs 51, 52, arranged on the opposite side of female buckle body 58 from the main opening 59 which receives male buckle body 60. Side legs 51, 52 are connected to top sections 53, 54, which are separated by a gap 580. Each top section 53, 54, is equipped with a locking hook 55,56, which interact with corresponding locking hooks on attachment portion 20 in the same way as described with respect to FIG. 8. Attachment portion 20 shown here is identical to attachment portion 20 from FIGS. 1-8.

Figure 4:
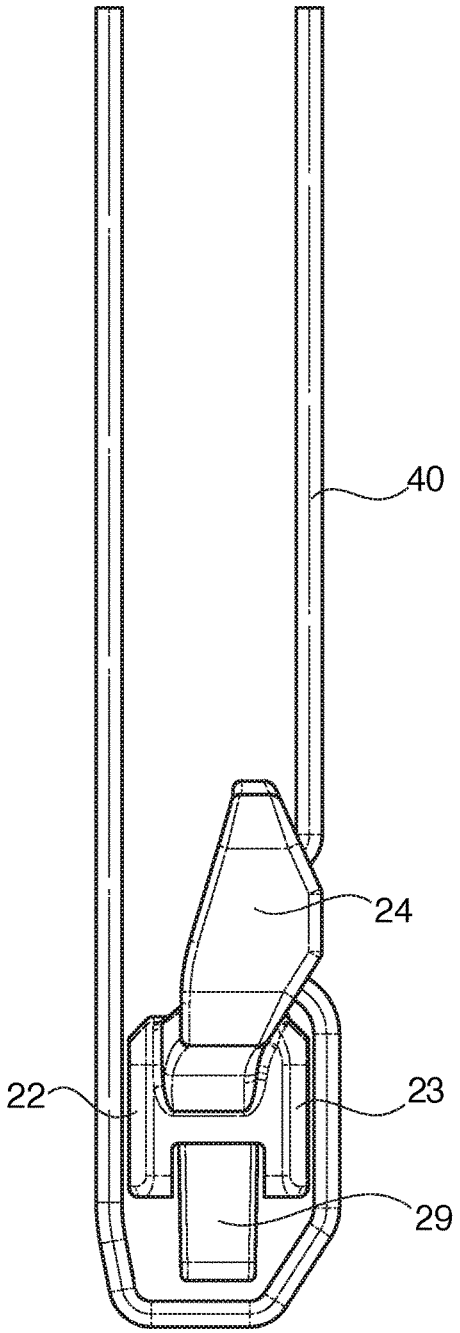
FIG. 4 is a view of the attachment portion connected with a webbing loop.

Strap 40 is connected to attachment portion 20 in the same manner as described with respect to FIG. 4, and then operating portion 50 is connected to attachment portion 20 to connect the system together, with strap 40 extending around and underneath top sections 53, 54 of operating portion 50, as shown in FIG. 11. A second strap 70 can be connected to male buckle body 60, so that the system can connect two straps 40, 70 together in a simple and secure fashion. Instead of a D-ring or side-release buckle, operating portion 30, 50 can take on any suitable structure, such as a swivel hook buckle, a swivel square ring, a press release buckle male part, a press release buckle female part, a magnetic auto-connecting buckle male part, a magnetic auto-connecting buckle female part, a ladder buckle, a tri-glide buckle, a snap button, an O-ring, a square ring, a triangular ring, a snap hook, or a rope adjusting buckle. It can also be any electronic device: a light-emitting device, a video screen, a telephone, a remote contact tool, a video camera, a video recorder, a microphone, an amplifier, a fan cooler, a fan heater, an insulation device, a portable power source, an electronic protective case, a tension meter, etc. The operating portion 50 can be interchanged with fixed attachment portion 20 so that different elements can be easily connected and disconnected from strap 40, without removing attachment portion 20. Side legs 51, 52 can be equipped with ridges 504 (see FIG. 9) to assist a user in gripping the operating portion 50.

Figure 12:
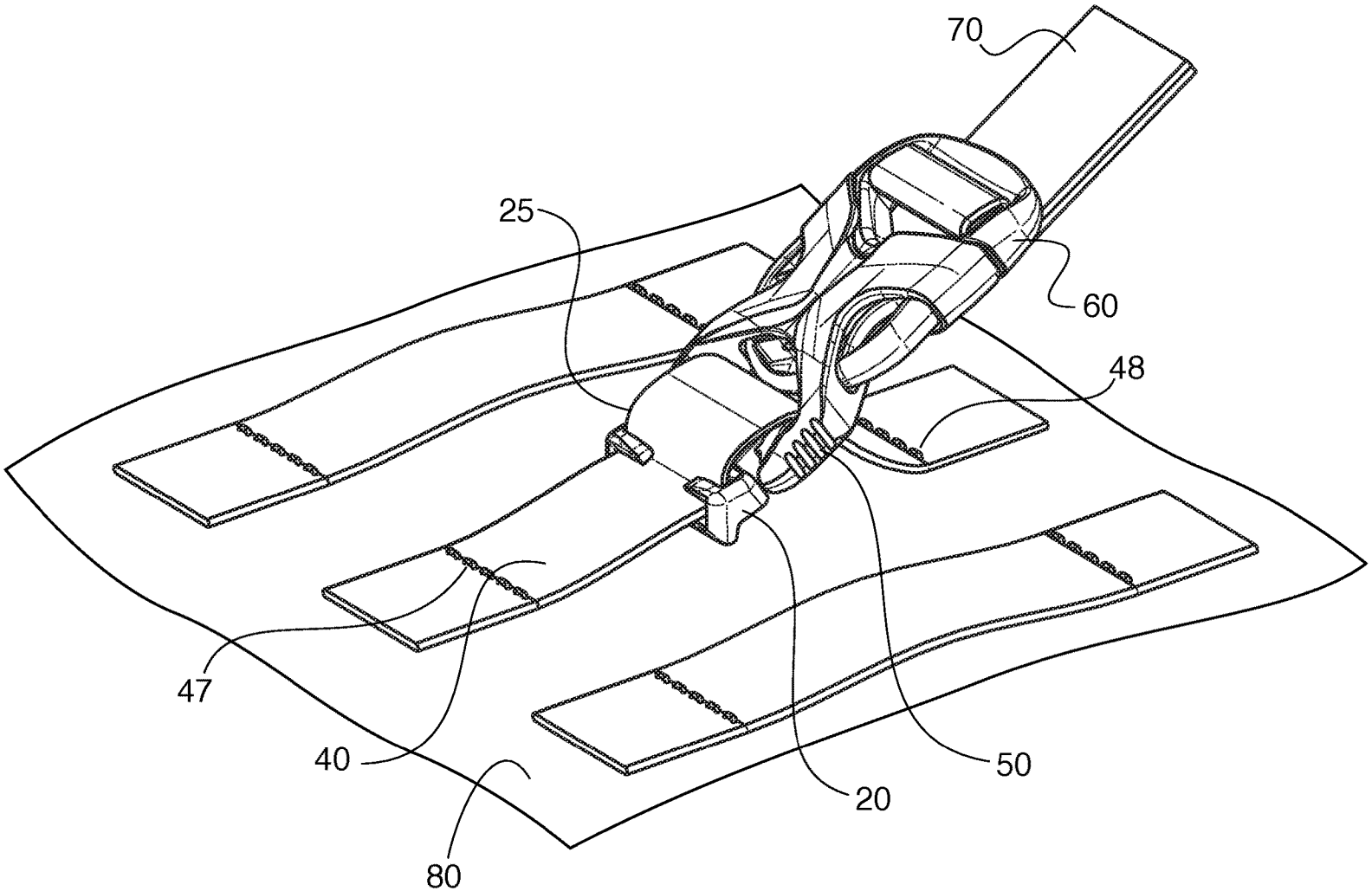
FIG. 12 is a perspective view of the attachment system of FIG. 9 in use on a Molle system.

Another alternative embodiment is shown in FIG. 12, which shows attachment portion 20 and operating portion 50 in a Molle system for use on a tactical vest or other item. Here, attachment portion 20 is connected to strap 40 in the same way as described above with respect to FIGS. 9-11. However, instead of strap 40 being sewn into a loop, strap 40 is sewn along attachment lines 47, 48 onto a substrate 80, which can be any type of flat sewable structure, such as a tactical vest. In use, strap 40 is first sewn in place and then attachment portion 20 is connected by fitting attachment bar 25 around strap 40, which places attachment portion 20 underneath strap 40. Then, operating portion 50 can be connected to attachment portion 20 in the same manner described above with respect to FIGS. 9-11. The flexible nature of the fabric of substrate 80 can be used to provide extra slack in the space between strap 40 and substrate 80 during assembly and disassembly of operating portion 50 with attachment portion 20. In use after assembly, the substrate is stretched flat so that there is little slack between attachment lines 47, 48. Tension on operating portion 50 by pulling strap 70 connected to male buckle body 60 only presses operating portion 50 more strongly against attachment portion 20, due to the pressure on operating portion 50 by attachment line 48.

Accordingly, while only a few embodiments of the present invention have been shown and described, it is obvious that many changes and modifications may be made thereunto without departing from the spirit and scope of the invention.

What is claimed is:

1. A system for attachment to webbing or a strap, comprising:

an attachment portion comprising a base body having front and back walls with a cavity between the front and back walls, at least one transverse bar connected to the base body and separated from the base body by a gap, and two locking hooks extending into the cavity in a direction opposite the at least one transverse bar, an operating portion having two side legs, and top sections connected to the side legs and having a gap between the top sections, such that squeezing the side legs together narrows the gap, wherein each of the top sections has a locking hook extending therefrom, and a strap connected to the attachment portion, the strap extending through a space between the at least one transverse bar and the base body, and around a bottom of the attachment portion, and being closed in a loop, so that the base body is contained within the loop, wherein the operating portion is connectable to the attachment portion by pressing the side legs together and inserting the locking hooks of the operating portion into the cavity of the attachment portion, and then releasing the side legs so that the locking hooks of the attachment portion engage the locking hooks of the operating portion, and wherein the operating portion is detachable from the attachment portion by squeezing the side legs together until the locking hooks on the operating portion clear the locking hooks on the attachment portion, and moving the operating portion away from the attachment portion.

2. The system according to claim 1, further comprising at least one prong extending from the attachment portion opposite the at least one transverse bar, the at least one prong being disposed in the gap between the top sections of the operating portion when the operating portion is attached to the attachment portion.

3. The system according to claim 2, wherein the at least one prong comprises two prongs.

4. The system according to claim 1, wherein the strap extends around a bottom of the top sections when the operating portion is connected to the attachment portion, so that tension on the strap in a direction of the transverse bar presses the operating portion more tightly against the attachment portion.

5. The system according to claim 1, wherein the rear back wall of the attachment portion has apertures therein so that the locking hooks of the operating portion are visible through the apertures when the operating portion is connected to the attachment portion.

6. A system for attachment to webbing or a strap, comprising:

an attachment portion comprising a base body having front and back walls with a cavity between the front and back walls, at least one transverse bar connected to the base body and separated from the base body by a gap, and two locking hooks extending into the cavity in a direction opposite the at least one transverse bar, an operating portion having two side legs, and top sections connected to the side legs and having a gap between the top sections, such that squeezing the side legs together narrows the gap, wherein each of the top sections has a locking hook extending therefrom, wherein the operating portion is connectable to the attachment portion by pressing the side legs together and inserting the locking hooks of the operating portion into the cavity of the attachment portion, and then releasing the side legs so that the locking hooks of the attachment portion engage the locking hooks of the operating portion, and wherein the operating portion is detachable from the attachment portion by squeezing the side legs together until the locking hooks on the operating portion clear the locking hooks on the attachment portion, and moving the operating portion away from the attachment portion, and wherein the operating portion is a D-ring.

7. A system for attachment to webbing or a strap, comprising:

an attachment portion comprising a base body having front and back walls with a cavity between the front and back walls, at least one transverse bar connected to the base body and separated from the base body by a gap, and two locking hooks extending into the cavity in a direction opposite the at least one transverse bar, an operating portion having two side legs, and top sections connected to the side legs and having a gap between the top sections, such that squeezing the side legs together narrows the gap, wherein each of the top sections has a locking hook extending therefrom, wherein the operating portion is connectable to the attachment portion by pressing the side legs together and inserting the locking hooks of the operating portion into the cavity of the attachment portion, and then releasing the side legs so that the locking hooks of the attachment portion engage the locking hooks of the operating portion, and wherein the operating portion is detachable from the attachment portion by squeezing the side legs together until the locking hooks on the operating portion clear the locking hooks on the attachment portion, and moving the operating portion away from the attachment portion, and wherein the operating portion is a female portion of a two-piece side-release buckle, wherein the operating portion has a main body connected to the side legs, and a cavity within the main body for receiving a male portion of the side-release buckle.

8. The system according to claim 7, further comprising a strap connected to a substrate at two points along the strap, and wherein the attachment portion is connected to the strap between the attachment points via the at least one transverse bar, so that the base body is disposed between the strap and the substrate.

9. The system according to claim 1, wherein the side legs are disposed outside of the base body when the operating portion is connected to the attachment portion.

10. The system according to claim 1, wherein the side legs are equipped with ridges to increase a user's grip.

* * * * *